US007275334B2

(12) United States Patent
Horst

(10) Patent No.: US 7,275,334 B2
(45) Date of Patent: Oct. 2, 2007

(54) METHOD AND APPARATUS FOR HANGING PICTURES AND THE LIKE

(76) Inventor: Patricia J. Horst, 1802 Birchwood La., Rockford, IL (US) 61107

( * ) Notice: Subject to any disclaimer, the term of this patent is extended or adjusted under 35 U.S.C. 154(b) by 0 days.

(21) Appl. No.: 11/287,755

(22) Filed: Nov. 28, 2005

(65) Prior Publication Data

US 2007/0119068 A1 May 31, 2007

(51) Int. Cl.
*G01B 5/25* (2006.01)

(52) U.S. Cl. ..... 33/666; 33/613; 248/467

(58) Field of Classification Search ..... 33/666, 33/613, 645; 24/DIG. 11; 248/467; 427/208
See application file for complete search history.

(56) References Cited

U.S. PATENT DOCUMENTS

| | | | | | |
|---|---|---|---|---|---|
| 264,947 | A * | 9/1882 | Heyl | 248/467 |
| 682,062 | A * | 9/1901 | Haberstroh | 24/DIG. 11 |
| 682,063 | A * | 9/1901 | Haberstroh | 24/DIG. 11 |
| 693,514 | A * | 2/1902 | Haberstroh | 24/DIG. 11 |
| 1,560,029 | A * | 11/1925 | Erickson | 248/467 |
| 3,884,443 | A * | 5/1975 | McMaster | 248/467 |
| 4,220,309 | A | 9/1980 | Eisen et al. | |
| 4,309,016 | A * | 1/1982 | Tendler | 248/467 |
| 4,310,137 | A * | 1/1982 | Frye | 248/467 |
| 4,336,884 | A | 6/1982 | Hart et al. | |
| 4,384,648 | A | 5/1983 | Hart et al. | |
| 4,756,498 | A * | 7/1988 | Frye | 248/467 |
| 4,875,654 | A * | 10/1989 | Chandonnet et al. | 248/467 |
| 5,039,047 | A * | 8/1991 | Pitzo | 248/467 |
| 5,398,906 | A | 3/1995 | Aydelott | |
| 6,574,880 | B2 | 6/2003 | Lombardo | |
| 6,612,060 | B2 * | 9/2003 | Pearce | 248/467 |
| 6,902,784 | B2 * | 6/2005 | Princell et al. | 427/208 |
| 2002/0066200 | A1 | 6/2002 | Lombardo | |
| 2004/0098875 | A1 | 5/2004 | Gould | |
| 2006/0075650 | A1 * | 4/2006 | Tatum | 33/666 |

* cited by examiner

*Primary Examiner*—G. Bradley Bennett
(74) *Attorney, Agent, or Firm*—Reinhart Boerner Van Deuren P.C.

(57) ABSTRACT

A method and apparatus are provided for hanging a picture, or the like, on the wall surface, through utilization of a fastener position indicator spot, having a spot-shaped body including oppositely facing first and second adhesive surfaces thereof, to indicate a desired location for placing a fastener on the wall surface.

28 Claims, 4 Drawing Sheets

METHOD AND APPARATUS FOR HANGING PICTURES AND THE LIKE

FIELD OF THE INVENTION

This invention relates generally to the hanging of pictures and the like on wall surfaces, and more particularly to a method and apparatus for facilitating positioning of a fastener on the wall surface, for supporting the picture or the like.

BACKGROUND OF THE INVENTION

Accurately locating a fastener, for supporting a picture or the like on a wall surface, can be frustrating, because it is often not possible to view the location of hanger brackets or wires attached to the back side of the picture or the like, while the picture or the like is viewed from the front side while being held at a desired location on the wall.

Through the years, many solutions have been proposed for facilitating the activity of hanging a picture or the like on a wall surface. Some of these prior approaches are documented in published United States Patent Application No. 2004/0098875 A1, to Gould, and in U.S. Pat. No.: 4,220,309 to Eisen et al.; U.S. Pat. No. 4,336,884 to Hart et al.; U.S. Pat. No. 4,384,648 to Hart et al.; U.S. Pat. No. 5,398,906 to Aydelott; and U.S. Pat. No. 6,574,880 B2 to Lombardo.

Previous approaches, such as those disclosed in the application and patents listed above, have not proved to be entirely satisfactory, however. An improved method and apparatus for hanging pictures and the like is desirable.

BRIEF SUMMARY OF THE INVENTION

The invention provides an elegantly simple improved method and apparatus for hanging a picture, or the like, on a wall surface, through utilization of a fastener position indicator spot, having a spot-shaped body including oppositely facing first and second adhesive surfaces thereof, to indicate a desired location for placing a fastener on the wall surface.

In one form of the invention, a position indicating spot, according to the invention, includes a spot-shaped body, defining first and second oppositely facing adhesive surfaces thereof, and a fastener locating feature. The fastener locating feature may be visible from only the first adhesive surface of the body of the spot. The fastener locating feature may include a through-hole in the body. The fastener locating feature may include a through-slit in the body. The fastener locating feature may include a peripheral shape of the body. The fastener locating feature may include both a through-hole in the body, and a slit in the body extending from the through-hole to an outer periphery of the body of the spot.

In some forms of the invention, wherein the picture or the like, to be hung on the wall, includes a hanger defining a wall-facing surface and a shaped feature of the hanger, the fastener locating feature may include a peripheral shape of the body of the spot which is configured for alignment with the shaped feature of the hanger.

In some forms of the invention, the first adhesive surface of the body of the spot may have a first adhesive strength, for adhesion to a wall-facing surface of the picture or the like, and the second adhesive surface of the body may have a greater adhesive strength than the first adhesive surface, for adhesion to the wall surface. By virtue of the differences in strengths between the first and second adhesive surfaces, the spot will tend to pull away from the wall-facing surface of the picture and remain attached to the wall surface, after being compressed against the wall surface while the picture or the like is being held in a desired location on the wall. The position indicating spot may further include a visible indicator, such as a marking or discernable color, for distinguishing the first adhesive surface from the second adhesive surface.

In some forms of the invention, the body of the spot is configured to separate, with part of the body remaining attached to the wall-facing surface and another part of the body remaining attached to the wall surface, after the spot is pressed against the wall surface by the wall-facing surface of the picture or the like.

In some forms of the invention, the body of the spot is formed from a felt-like material. In other forms of the invention, the body of the spot is formed from a foam material. In the other forms of the invention, the body may be formed from other types of resilient or non-resilient materials, or combinations of such materials.

The invention may also take the form of a method for hanging a picture, or the like, on a wall surface, with the method including, indicating a location, for placing a fastener on the wall surface, with a fastener position indicating spot having a spot-shaped body including oppositely facing first and second adhesive surfaces thereof. Where the picture, or the like, includes a wall-facing surface thereof, the method may further include, first adhesively attaching the first adhesive surface of the spot to the wall-facing surface, and then attaching the second adhesive surface of the spot to the wall surface by pressing the picture or the like against the wall surface while the spot is attached by the first adhesive surface of the spot to the wall facing surface. A method, according to the invention, may further include positioning the picture or the like, by holding it near the wall surface, prior to pressing the picture or the like against the wall surface while the spot is attached by the first adhesive surface of the spot to the wall facing surface. A method, according to the invention, may yet further include separating the first adhesive surface of the spot from the wall facing surface, by pulling the picture or the like away from the wall, while the spot remains attached to the wall surface by the second adhesive surface of the spot.

A method, according to the invention, may also include configuring the spot to provide a fastener locating feature, and securing a fastener to the wall at the fastener locating feature of the spot.

Some forms of a method, according to the invention, include removing the spot from the wall surface after the fastener is secured to the wall. Other forms of a method, according to the invention, include leaving the spot attached to the wall after securing the fastener to the wall. A method, according to the invention, may further include fabricating the spot from a material providing a stabilizing force against the wall facing surface of the picture or the like, when the picture or the like is suspended by the fastener.

Some forms of a method, according to the invention, may include configuring the body of the spot to separate, with a first part of the body remaining attached to the wall-facing surface and a second part of the body remaining attached to the wall surface, after the spot has pressed against the wall surface by the wall-facing surface, with the method further including pulling the picture or the like away from the wall, to leave the first part of the body attached to the wall facing surface, and a second part of the body attached to the wall surface. The method may further include configuring at least the second part of the body of the spot to include a fastener locating feature, and securing a fastener to the wall at the fastener locating feature of the spot. The method may also include removing either or both of the first and second parts of the body, from the corresponding wall-facing surface or wall surface, after the fastener is secured to the wall. Alternatively, a method, according to the invention, may include leaving either or both of the first and second parts of the body attached to the corresponding wall-facing surface or wall surface, after the fastener is secured to the wall.

In forms of the invention where the fastener position indicating spot includes a visible indicator, the visible indicator may be formed integrally with either the first or the second adhesive surface of the body of the spot. Alternatively, the visible indicator may be removably secured to either the first or second adhesive surface of the body of the spot. In some forms of the invention, such a removably secured visible indicator may take the form of a protective layer, precluding attachment of the spot to a surface, until the visible indicator is removed.

Other aspects, objects and advantages of the invention will be apparent from the following detailed description and accompanying drawings.

BRIEF DESCRIPTION OF THE DRAWINGS

The accompanying drawings incorporated in and forming a part of the specification illustrate several aspects of the present invention and, together with the description, serve to explain the principles of the invention. In the drawings.

While the invention will be described in connection with certain preferred embodiments, there is no intent to limit it to those embodiments. On the contrary, the intent is to cover all alternatives, modifications and equivalents as included within the spirit and scope of the invention as defined by the appended claims.

DETAILED DESCRIPTION OF THE INVENTION

Figure 1:
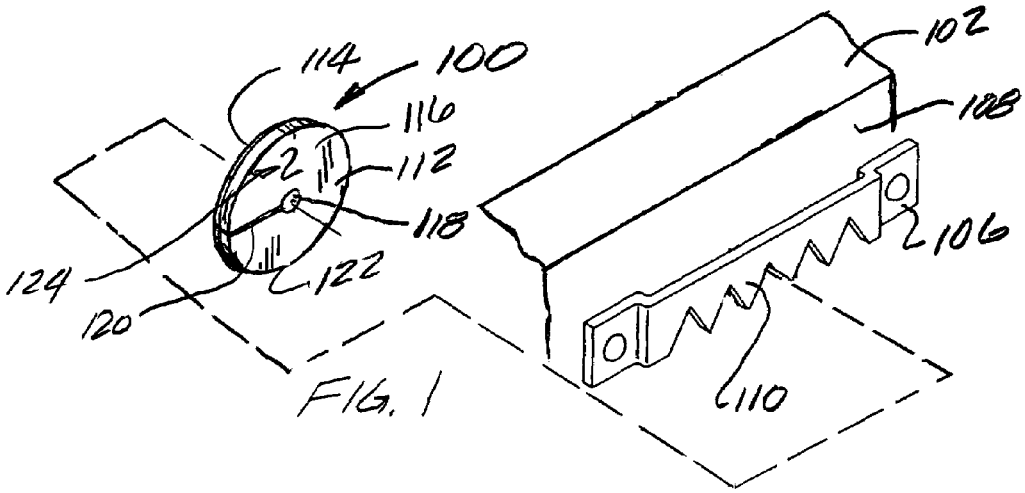
FIGS. 1-10, show a first exemplary embodiment of a fastener position indicating spot, according to the invention, and the manner in which the first exemplary embodiment of the positioning indicating spot may be utilized for facilitating attachment of a picture, or the like, to a wall surface.
Figure 2:
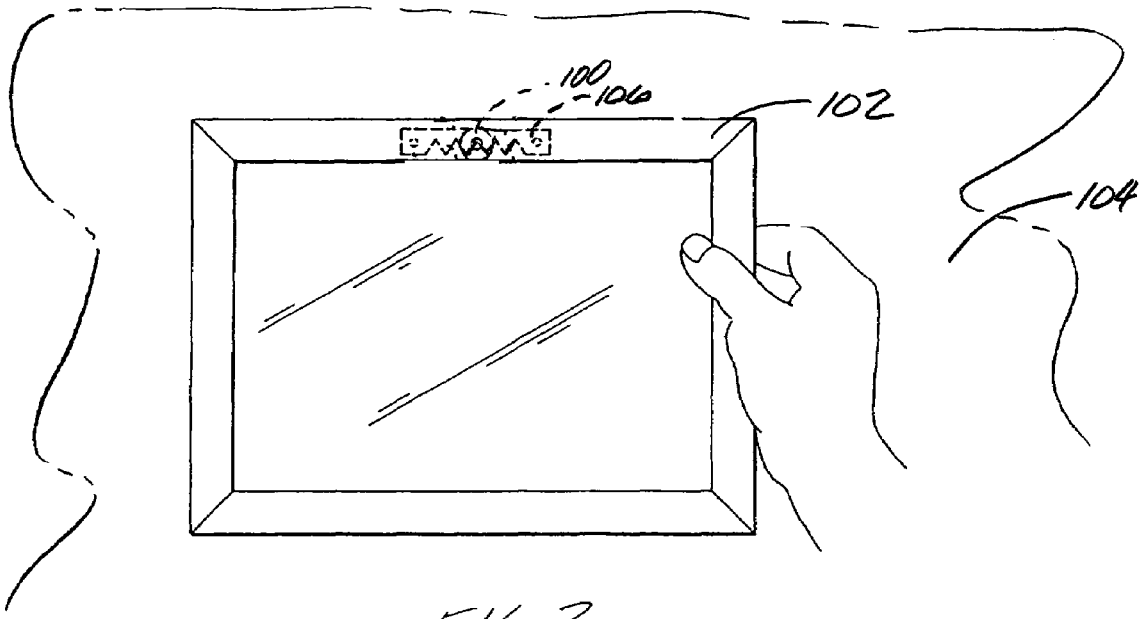

FIGS. 1 and 2 show a first exemplary embodiment of a fastener position indicating spot 100, for hanging a picture 102, or the like, on a wall surface 104, in the manner discussed in more detail below with reference to FIGS. 3-10. In the first exemplary embodiment, the picture 102 has a hanger bracket 106 attached to a rear surface 108 of the picture 102. The hanger bracket 106, of the first exemplary embodiment, defines a wall-facing surface 110, disposed adjacent the wall surface 104.

As used herein, the terms "picture, or the like," is intended to be broadly construed, to include, but not be limited to, a wide variety of wall mounted objects such as: framed or unframed artwork, photographs, posters, sculpture or other artifacts, mirrors, sconces, shelves, etc.

The fastener position indicating spot 100, of the first exemplary embodiment, includes a spot-shaped body 112 defining first and second oppositely facing adhesive surfaces 114, 116 thereof. The first exemplary embodiment of the spot 100 further includes a fastener locating feature, in the form of a through-hole 118, and a slit 120 extending through the body 112 from the through-hole 118 to an outer periphery 122 of the body 112.

Figure 11:
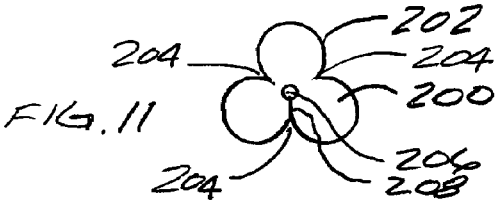
FIGS. 11-15 illustrate a number of other exemplary embodiments of a fastener position indicating spot, according to the invention, with FIG. 15 further illustrating an embodiment of the invention in which a plurality of position indicating spots, according to the invention, may be supplied to a user attached to a common protective sheet.
Figure 12:
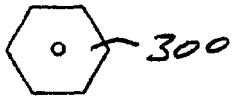
Figure 13:
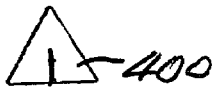
Figure 14:
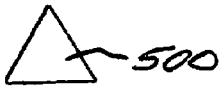
Figure 15:
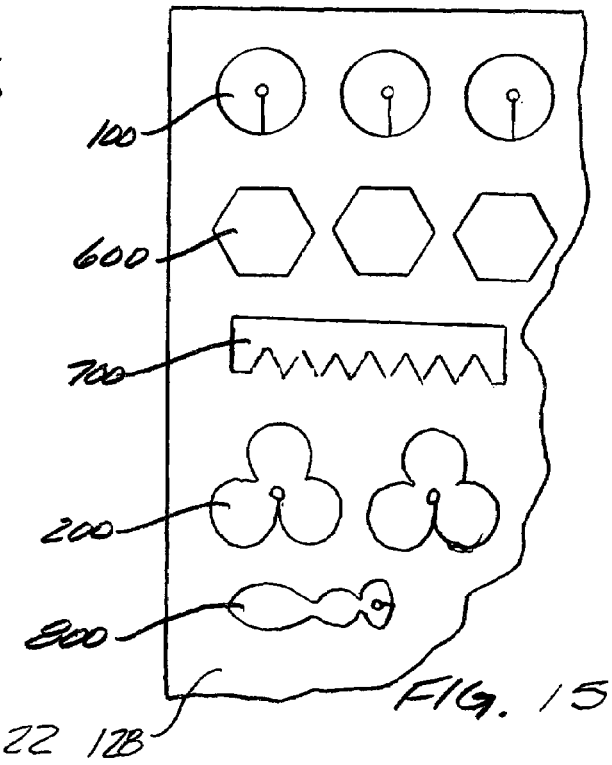
Figure 17:
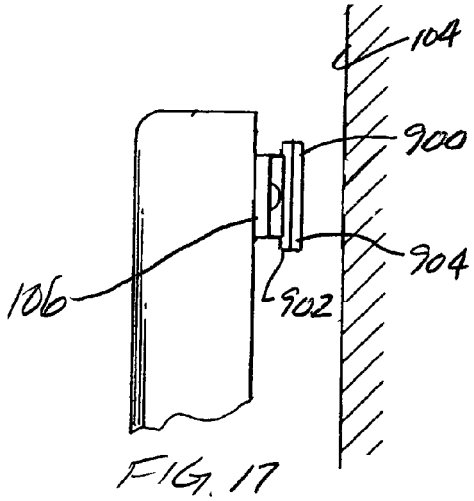
FIG. 16-21 illustrate an embodiment of a fastener position indicating spot, according to the invention, having first and second separable parts thereof, and the manner in which such a separable position indicating spot may be utilized for hanging a picture, or the like, on a wall surface, in accordance with the invention.
Figure 16:
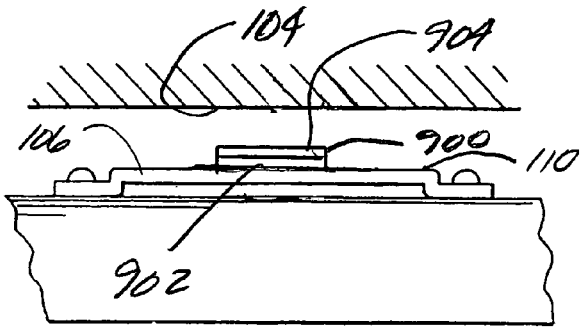
Figure 19:
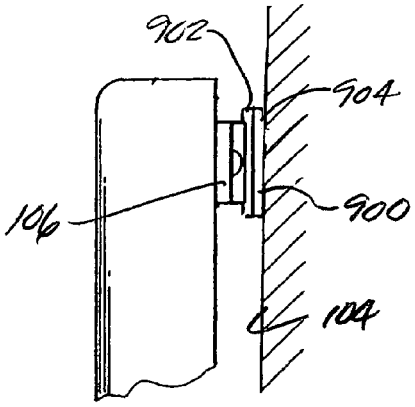
Figure 18:
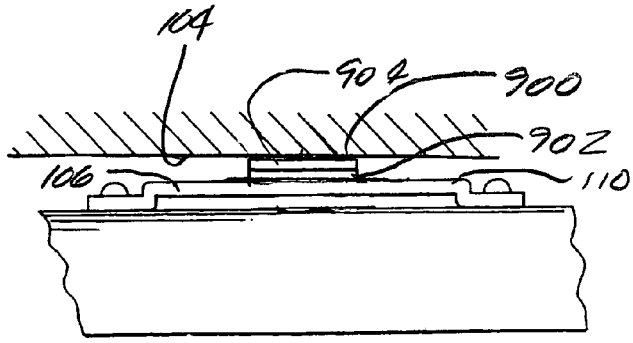
Figure 21:
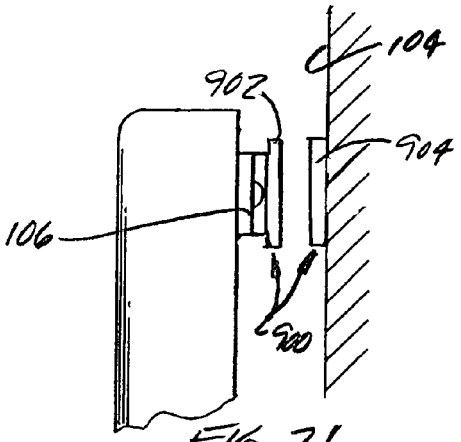
Figure 20:
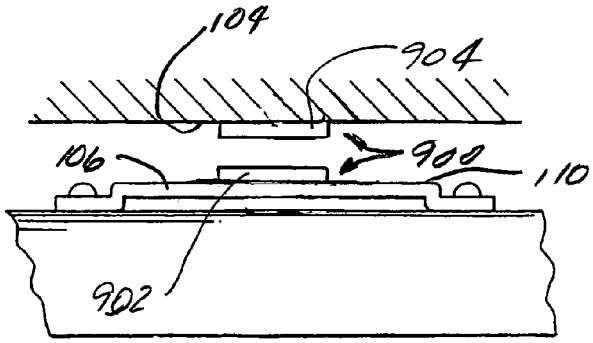

It will be understood that, although the first exemplary embodiment of the fastener position indicating spot 100 has a generally circular periphery, with a centrally located through-hole and radially extending slit 120, in other embodiments of the invention, a position indicating spot may take a variety of other forms, some of which are shown in FIGS. 11-15. For example, a second exemplary embodiment of a position indicating spot 200, according to the invention, as shown in FIG. 11, has a somewhat clover-leaf-shaped outer periphery 202, defining three indentations 204 which may serve as fastener locating features, in addition to a through-hole 206 and a slit 208 extending therefrom to the periphery 202. The embodiments of position indicating spots 300, 400, 500, shown in FIGS. 12-14, have peripheries that are respectively hexagonal or triangular shaped, with the corners of the respective peripheries also potentially serving as fastener locating features, according to the invention. A seventh exemplary embodiment of a position indicating spot 700, as shown in FIG. 15, has an outer periphery configured to align substantially with the hedges of the wall-facing surface 110 of the hanger bracket 106, shown in FIGS. 1-8. A position indicating spot, according to the invention, may also have a fancifully shaped periphery, such as the bug-shaped spot 800 shown in FIG. 15.

In the first exemplary embodiment of a fastener position indicator spot 100, according to the invention, the first adhesive surface 114 of the body 112 of the spot 100 has a first adhesive strength, selected for adhesion to the wall-facing surface 110, in the manner indicated by the dashed lines in FIG. 1. The second adhesive surface 116, of the body 112 of the first exemplary embodiment of the spot 100, has a greater adhesive strength than the first adhesive surface 114, with the second adhesive surface being configured for adhesion to the wall surface 108. The second adhesive surface 116 is marked with a visible indicator, in the form of a "2," as indicated at 124 in FIG. 1, for distinguishing the first adhesive surface 114 from the second adhesive surface 116.

FIGS. 1-10 illustrate a method for hanging the picture 102 on the wall surface 104, through practice of the invention, by indicating a location for placing a fastener on the wall surface 104, using the fastener position indicator spot 100.

Figure 4:
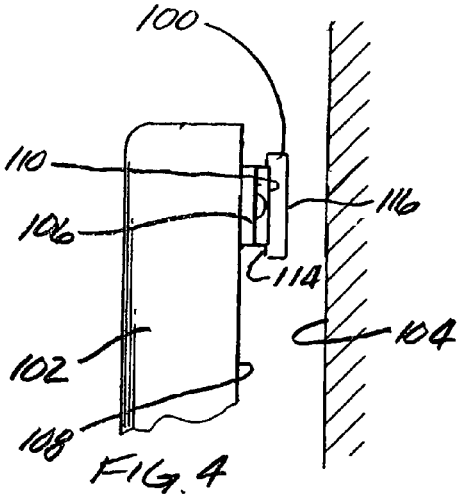
Figure 3:
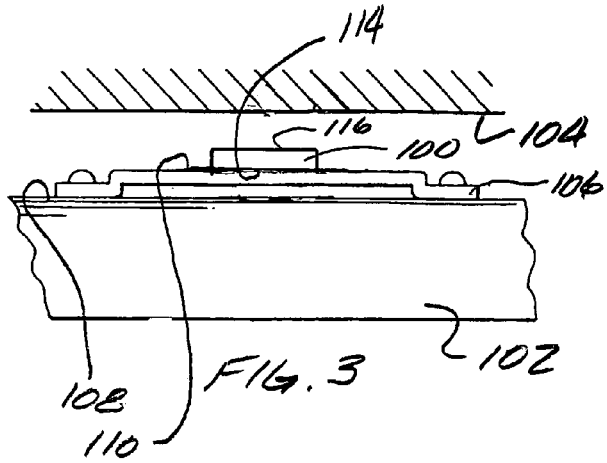
Figure 6:
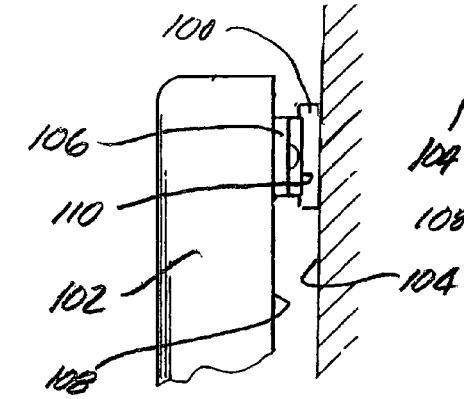
Figure 5:
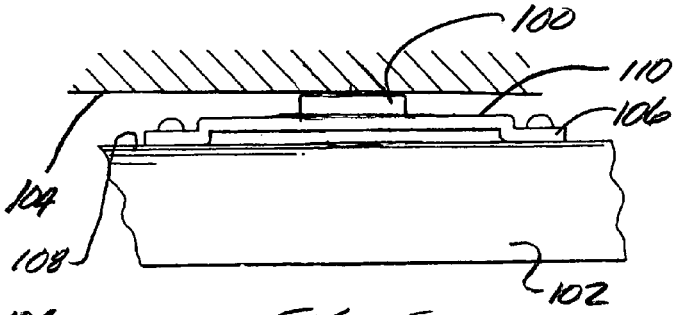
Figure 8:
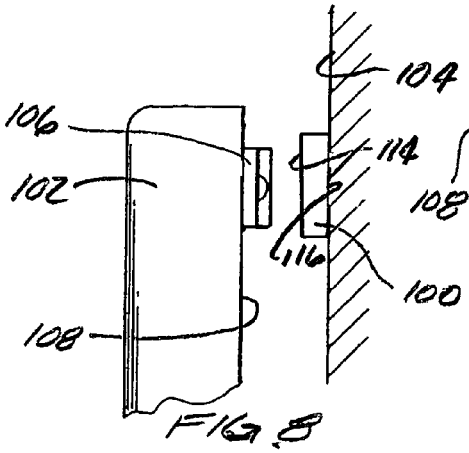
Figure 7:
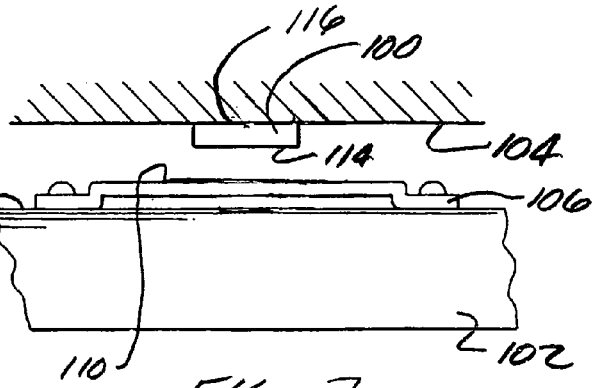

As shown in FIGS. 1, and 3-4, the first adhesive surface 114 of the spot 100 is used to secure the spot 100 at a desired location on the wall-facing surface 110 of the hanger bracket 106 of the picture 102. The picture 102 is then positioned at a desired location along the wall surface 104, as shown in FIG. 2. While maintaining the picture 102 in the desired location with respect to the wall 104, the picture 102 is used to press the second adhesive surface 116 of the spot 100 against the wall surface 104, as illustrated in FIGS. 5 and 6. The picture 102 is then pulled away from the wall surface 104, with the stronger adhesive on the second adhesive face 116 of the spot 100 causing the spot 100 to remain attached to the wall 104, with a corresponding separation of the first adhesive surface 114 of the spot 100 from the wall-spacing surface 110, after the picture 100 is pulled away from the wall surface 104.

Figure 9:
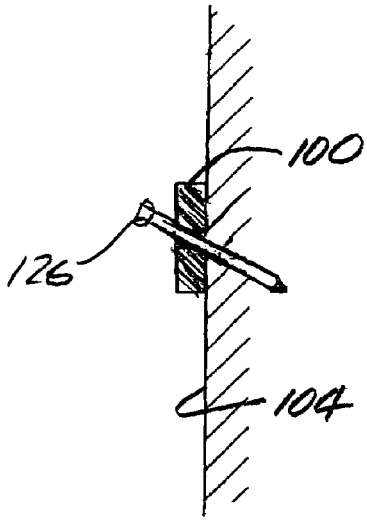
Figure 10:
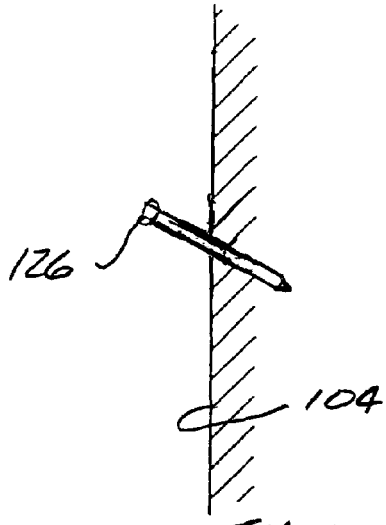

As shown in FIG. 9, a fastener, such as a nail 126, shown in FIGS. 10 and 11 in relation to the first exemplary embodiment, may be driven through the through-hole 118 of the spot 100 into the wall, for use in hanging the picture 102 on the wall at the desired location. In some embodiments of the invention, after the fastener 126 is driven into, or otherwise attached to the wall surface 104, the spot 100 may be peeled away from the wall surface 104, as shown in FIG. 10. The slit 120 in the spot 100 facilitates removal of the spot 100, after installation of the fastener 126.

It will be noted, however, that in some embodiments of the invention, particularly where the spot 100 is fabricated from a material such as felt, plastic foam, or another resilient material, it may be desirable to leave the spot 100 in position to provide cushioning and a stabilizing force against the wall-facing surface 110 of the picture 102, when the picture 102 is suspended on the fastener 126.

FIGS. 16-21 illustrate a ninth embodiment of a fastener position indicating spot 900, according to the invention, in which the body of the spot 900 is configured to separate into a first part 902 adapted for remaining attached to the wall facing surface 110 of the hanger bracket 106, and a second part 904 of the body of the spot 900 adapted to remain attached to the wall surface 104, after the spot 900 is pressed against the wall surface 104 by the wall facing surface 110. By virtue of this arrangement, as the picture 102 is pulled away from the wall surface 104, the first part 902 remains attached to the wall-facing surface 110 of the hanger bracket 106, and the second part 904 of the body of the spot 900 remains attached to the wall surface 104.

Those having skill in the art, will readily appreciate, that it is desirable, in practicing the invention, that at least the second part 904 of the body of the spot 900 include a fastener locating feature, of the type described above in relation to the first exemplary embodiment of the spot 100, or other exemplary embodiments within the scope of the invention. Similarly, in the same manner as described above in relation to the first exemplary embodiment of the spot 100, either, or both of, the first and second parts 902, 904 of the body of the ninth exemplary embodiment of the spot 900 may be left attached to their corresponding wall-facing surface 110 or wall surface 104, after the positioning spot 900 is utilized for securing a fastener to the wall 104.

In practicing the invention, a fastener locating feature may extend entirely through the body of a spot, according to the invention, in the manner described above with regard to the through-holes, and or slits in the first, second, third, fourth, and eighth exemplary embodiments of the invention. In some embodiments of the invention, however, the fastener locating feature may take other forms, such as a dimple extending into the body of the spot from the first adhesive surface of the spot, or may alternatively take the form of a visible cross-hairs, or other marking applied to the first adhesive surface of the spot.

Figure 22:
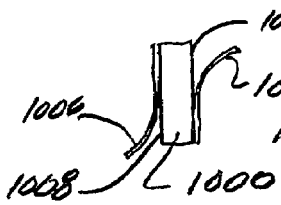
FIG. 22 illustrates an embodiment of a fastener position indicating spot, according to the invention, having removable protective sheets applied to first and second adhesive surfaces of the position indicating spot.

Visual indicators provided, in accordance with the invention, for differentiating the first adhesive surface of the spot from the second adhesive surface of the spot may either be integrally formed with the first adhesive surface of the body of the spot, such as the Arabic figure shown in FIG. 1, or may be removably secured to at least one of the first and/or second adhesive surfaces of the body of the spot, in the manner indicated in FIG. 22. In the embodiment illustrated in FIG. 22, a tenth exemplary embodiment of a fastener position indicating spot 1000, according to the invention, includes a first removable protective layer 1002 attached to the first adhesive surface 1004, and a second removable protective layer 1006 attached to the second adhesive surface 1008 of the spot 1000. For embodiments of the invention in which it is desirable to distinguish the first adhesive surface 1104 from the second adhesive surface 1108 of the spot 1000, the first and second removable protective layers 1002, 1006 respectively may be made of different colors, have identifying indusial printed on them, or have different shapes or surface textures allowing the first and second adhesive surfaces 1004, 1008 to be distinguished from one another.

A wide variety of materials may be utilized for constructing position indicating spots, according to the invention. For example, a felt-type material may be utilized, with a felt-type material having a thickness of approximately ¼" having been shown to provide desirable results. As indicated above, foam materials fabricated from plastic, rubber, or other types of resilient materials may also be utilized with efface. In embodiment of the invention having a first and second part which are separable from one another, the spot may be fabricated from materials such as felt, having material properties which result in the body of the spot separating into the first and second parts, rather than pulling free from either of the surfaces to which the spot is attached. Alternatively, two part spots may be fabricated from multiple pieces of cardboard, paper, plastic, etc. joined to one another along their faying surfaces by an adhesive having a lower strength than the adhesive applied to either the first or second adhesive surfaces of the spot.

Although the invention has been described herein, with regard to certain exemplary embodiments, many other embodiments are also possible. For example, FIG. 15 exhibits an embodiment of the invention in the form of a sheet of protective material 128, to which a variety of spots 100, 200, 600, 700, 800, having different shapes are attached, to provide a selection of various embodiments of position indicating spots, according to the invention, from which a user may select the form most applicable to a particular application of the invention.

Although all of the exemplary embodiments of a fastener position indicating spot, according to the invention, described above are utilized for directly locating the position of a fastener for hanging a picture or the like, it will be understood by those having skill in the art that a position indicating spot, according to the invention, may also be utilized with a pencil, or other marking instrument, for merely marking a desired location for a fastener on the wall surface. It will be further appreciated, that although the fastener described above, in relation to the exemplary embodiments presented herein, is a single nail, the invention may also be used with great efficacy in locating fasteners which connect picture-hanging hooks to the wall surface, or with pictures having a wire attached to the rear surface thereof for hanging the picture on a fastener or hook protruding from the wall surface.

Those having skill in the art will appreciate that the invention provides considerable improvement in the art, through the elegant simplicity of design and use afforded by the invention. An apparatus, or a method, according to the invention provide means and a method for facilitating hanging of a picture, or the like, on a wall, which can be produced, marketed, and used at substantially lower cost, and with less difficulty, for use in a wider range of applications than is afforded by prior approaches.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A fastener position indicating spot, for facilitating proper placement on a wall of a fastener used to support a wall-mounted object on the wall, with the wall-mounted object having a wall-facing surface disposed adjacent the wall surface, the spot comprising:

a substantially planar spot-shaped body, defining first and second oppositely facing adhesive surfaces thereof, and including a fastener locating feature;

the first adhesive surface being adapted for temporary attachment to the wall-facing surface of the wall-mounted object;

the second adhesive surface being adapted for temporary adhesion to the wall surface when pressed against the wall surface by the wall-facing surface in such a manner that at least a portion of the spot shaped body containing the fastener locating feature remains attached to the wall surface after the wall-facing surface is subsequently pulled away from the wall.

2. The spot of claim 1, wherein the fastener locating feature comprises a through-slit in the body.

3. The spot of claim 1, wherein the fastener locating feature is visible from only the first adhesive surface of the body of the spot.

4. The spot of claim 1, wherein the fastener locating feature comprises a peripheral shape of the body.

5. The spot of claim 1, wherein the wall-mounted object, includes a hanger defining the wall-facing surface and a shaped feature of the hanger, and the fastener locating feature defined by the peripheral shape of the body of the spot is configured for alignment with the shaped feature of the hanger.

6. The spot of claim 1, wherein the fastener locating feature comprises a through-hole in the body.

7. The spot of claim 6, further comprising, a slit in the body extending from the through-hole to an outer periphery of the body of the spot.

8. The spot of claim 1, wherein the first adhesive surface of the body of the spot has a first adhesive strength, for adhesion to the wall-facing surface of the picture or the like, and the second adhesive surface of the body has a greater adhesive strength than the first adhesive surface, for adhesion to the wall surface.

9. The spot of claim 2, further comprising a visible indicator for distinguishing the first adhesive surface from the second adhesive surface.

10. The spot of claim 1, wherein the body of the spot is configured to separate, with part of the body remaining attached to the wall-facing surface and another part of the body remaining attached to the wall surface, after the spot is pressed against the wall surface by the wall-facing surface.

11. The spot of claim 10, wherein the body of the spot is formed from a felt-like material.

12. The spot of claim 10, wherein the body of the spot is formed from a foam material.

13. The spot of claim 10, wherein the body comprises a resilient material.

14. A method for hanging a wall-mounted object, on a wall surface, with the wall-mounted object having a wall-facing surface disposed adjacent the wall surface, the method comprising:

indicating a location for placing a fastener on the wall surface, through use of a substantially planar spot-shaped body, defining first and second oppositely facing adhesive surfaces thereof, and including a fastener locating feature, wherein, the first adhesive surface is adapted for at least temporary attachment to the wall-facing surface of the wall-mounted object, and also wherein, the second adhesive surface is adapted for adhesion to the wall surface when pressed against the wall surface by the wall-facing surface in such a manner that at least a portion of the spot shaped body containing the fastener locating feature remains attached to the wall surface after the wall-facing surface is subsequently pulled away from the wall.

15. The method of claim 14, wherein, the method further comprises:

adhesively attaching the first adhesive surface of the spot to the wall-facing surface of the wall-mounted object;

attaching the second adhesive surface of the spot to the wall surface by pressing the wall-mounted object against the wall surface while the spot is attached by the first adhesive surface of the spot to the wall facing surface;

pulling the wall-mounted object away from the wall surface; and leaving at least a portion of the spot shaped body containing the fastener locating feature remaining attached to the wall surface after the wall-facing surface is pulled away from the wall.

16. The method of claim 15, further comprising, positioning the wall-mounted object by holding it near the wall surface, prior to pressing the wall-mounted object against the wall surface while the spot is attached by the first adhesive surface of the spot to the wall facing surface.

17. The method of claim 15, further comprising separating the first adhesive surface of the spot from the wall-facing surface by pulling the wall-mounted object away from the wall, while the spot remains attached to the wall surface by the second adhesive surface of the spot.

18. The method of claim 17, further comprising, securing a fastener to the wall at the fastener locating feature of the spot.

19. The method of claim 18, further comprising, removing the at least a portion of the spot including the fastener locating feature from the wall surface after the fastener is secured to the wall.

20. The method of claim 18, further comprising, leaving the at least a portion of the spot including the fastener locating feature attached to the wall after securing the fastener to the wall.

21. The method of claim 20, further comprising fabricating the spot from a material providing a stabilizing force against the wall-facing surface of the picture or the like when the picture or the like is suspended by the fastener.

22. The method of claim 15, further comprising:

configuring the body of the spot to separate, with a first part of the body remaining attached to the wall-facing surface and a second part of the body remaining attached to the wall surface, after the spot is pressed against the wall surface by the wall-facing surface; and pulling the picture or the like away from the wall, to leave the first part of the body attached to the wall-facing surface, and the second part of the body attached to the wall surface.

23. The method of claim 22, further comprising securing a fastener to the wall at the fastener locating feature of the spot.

24. The method of claim 23, further comprising, removing either or both of the first and second parts of the body, from the corresponding wall-facing surface or wall surface, after the fastener is secured to the wall.

25. The method of claim 23, further comprising, leaving either or both of the first and second parts of the body attached to the corresponding wall-facing surface or wall surface, after the fastener is secured to the wall.

26. A fastener position indicating spot, for hanging a wall-mounted object on a wall surface, with the wall-mounted object having a wall-facing surface disposed adjacent the wall surface, the spot comprising:

a substantially planar spot-shaped body, defining a periphery thereof and first and second oppositely facing adhesive surfaces thereof, and including a fastener location feature having a through-hole in the body and a slit in the body extending from the through-hole to the outer periphery of the body;

the first adhesive surface of the body having a first adhesive strength, for temporary adhesion to the wall facing surface of the wall-mounted object, and the second adhesive surface of the body having a greater adhesive strength than the first adhesive surface, for temporary adhesion to the wall surface; and a visible indicator for distinguishing the first adhesive surface from the second adhesive surface.

27. The spot of claim 26, wherein the visible indicator is integrally formed with at least one of the first and/or second adhesive surfaces of the body of the spot.

28. The spot of claim 26, wherein the visible indicator is removably secured to at least one of the first and/or second adhesive surfaces of the body of the spot.

* * * * *